US007389892B2

(12) United States Patent
Park

(10) Patent No.: US 7,389,892 B2
(45) Date of Patent: Jun. 24, 2008

(54) DYE CUP

(75) Inventor: Young-soo Park, Tokyo (JP)

(73) Assignee: Park Way Co., Ltd., Tokyo (JP)

( * ) Notice: Subject to any disclaimer, the term of this patent is extended or adjusted under 35 U.S.C. 154(b) by 262 days.

(21) Appl. No.: 10/552,346

(22) PCT Filed: Apr. 12, 2004

(86) PCT No.: PCT/JP2004/005203

§ 371 (c)(1),
(2), (4) Date: Oct. 7, 2005

(87) PCT Pub. No.: WO2004/091336

PCT Pub. Date: Oct. 28, 2004

(65) Prior Publication Data

US 2006/0196522 A1 Sep. 7, 2006

(30) Foreign Application Priority Data

Apr. 11, 2003 (JP) ..... 2003-107643

(51) Int. Cl.
*B65D 25/00* (2006.01)
*B65D 83/10* (2006.01)

(52) U.S. Cl. ..... 220/697; 132/148; 206/361; 220/736

(58) Field of Classification Search ..... 206/1.7, 206/1.8, 217, 581, 557, 564, 361, 527, 823; 132/148, 219; 220/695, 697, 735, 736
See application file for complete search history.

(56) References Cited

U.S. PATENT DOCUMENTS

| | | | | | |
|---|---|---|---|---|---|
| 2,110,041 | A | * | 3/1938 | Carawan | 132/148 |
| 5,154,193 | A | * | 10/1992 | Busch et al. | 132/110 |
| 5,165,335 | A | * | 11/1992 | Bianchi | 100/112 |
| 5,845,651 | A | * | 12/1998 | de Nervo | 132/114 |

FOREIGN PATENT DOCUMENTS

| | | | | |
|---|---|---|---|---|
| JP | 408056737 | A | * | 3/1996 |
| JP | 303457 | U | | 12/1996 |
| JP | 2000-201722 | A | | 7/2000 |
| JP | 2000-316627 | A | | 11/2000 |
| JP | 3088100 | U | | 6/2002 |

OTHER PUBLICATIONS

Form PCT/IB/338 Jan. 2004, Notification of Transmittal of copies of Translation, (Mailed) Mar. 9, 2006.
Form PCT/IB/373, Jan. 2004, PCT International Preliminary Report on Patentability, (Date of Issuance of report) Mar. 2, 2006.
Form PCT/ISA/237, Jan. 2004, PCT International Searching Authority, Written Opinion.
International Search Report mailed on Jul. 20, 2004.

* cited by examiner

*Primary Examiner*—Luan K Bui
(74) *Attorney, Agent, or Firm*—Rader, Fishman & Grauer, PLLC

(57) ABSTRACT

A cup part with a top open for containing a dye therein is included, and comb teeth are provided side by side at an upper end surface of the cup part or an inner surface of the cup part. By utilizing the comb teeth, operations of scraping an unnecessary dye off a brush or the like and settling the shape of the brush portion or the like can be facilitated, and hair, dust and the like attaching to the brush or the like can be removed without contaminating hands.

3 Claims, 5 Drawing Sheets

DYE CUP

TECHNICAL FIELD

The present invention relates to a dye cup for containing a dye such as a hair color cup.

BACKGROUND ART

In a barber's shop, a beauty salon or the like, a barber or a hair dresser applies a hair color to the hair of a customer by scooping out the hair color from a cup with a brush or the like with the cup containing the hair color (a hair dye for dying hair) placed near a head of the customer sitting in a chair. Concerning a pair color cup, for example, Japanese Patent Application Laid-open No. 2000-316627 is known.

On applying a hair color, a brush portion at a tip end of a brush or the like is temporarily soaked in the hair color in a cup, then, the brush portion is pressed against a cup upper end portion or the like to scrape off the needless hair color, and after the shape of the brush portion is settled, the hair color is applied to the hair of a customer. With the conventional hair color cup, the problem of dropping a hair color outside the cup by mistake, or of the hair color scraped off the brush portion dropping outside from the cup upper end portion easily occurs when scraping the unnecessary hair color off the brush portion as above, and settling the shape of the brush portion.

Besides, when a hair color is applied to the hair of a customer with a brush or the like, hair (fallen hair or the like), dust and the like sometimes attach to the brush or the like, and in this case, the hair color attaches to hair, dust and the like which attach to the brush or the like, extending off the brush or the like, and therefore, when the hair color is directly applied, the problem that the hair color attaching to hair, dust and the like attaches to the other portions than the hair and scalp, and contaminates the face, skin and clothes of the customer occurs.

In order to avoid such a problem, a barber and a hairdresser remove hair, dust and the like which attach to brushes or the like by hands each time when applying hair colors, but in doing so, the hair colors attach to the hands of the barber and the hair dresser. Besides, there occurs the problem that by touch of the hands to which such hair colors attach, the faces, the skins or the clothes of the customers, or the surroundings are contaminated.

DISCLOSURE OF THE INVENTION

Accordingly, an object of the present invention is to make it possible to facilitate operations of scraping an unnecessary dye off a brush or the like and settling a shape of a brush portion or the like, and make it possible to remove hair, dust and the like attaching to the brush or the like without contaminating hands, in a dye cup for containing a dye therein, such as a hair color cup.

In order to achieve the above object, a dye cup of the present invention has a cup part with a top open for containing a dye therein, and comb teeth are provided side by side at an upper end surface of the cup part or at an inner surface of the cup part. The aforesaid dye is, for example, a hair color. A recessed portion may be formed at an upper position of the inner surface of the cup part, and a plurality of comb teeth may be provided side by side in this recessed portion. Besides, a handle part for holding the cup part may be provided at an outer side of the cup part, and the aforesaid comb teeth may be provided in a vicinity of a base portion of the handle part.

According to the present invention, operations of scraping an unnecessary dye off the brush or the like and settling the shape of the brush portion or the like can be facilitated, and hair, dust and the like attaching to the brush or the like can be removed without contaminating hands.

BEST MODE FOR CARRYING OUT THE INVENTION

Figure 1:
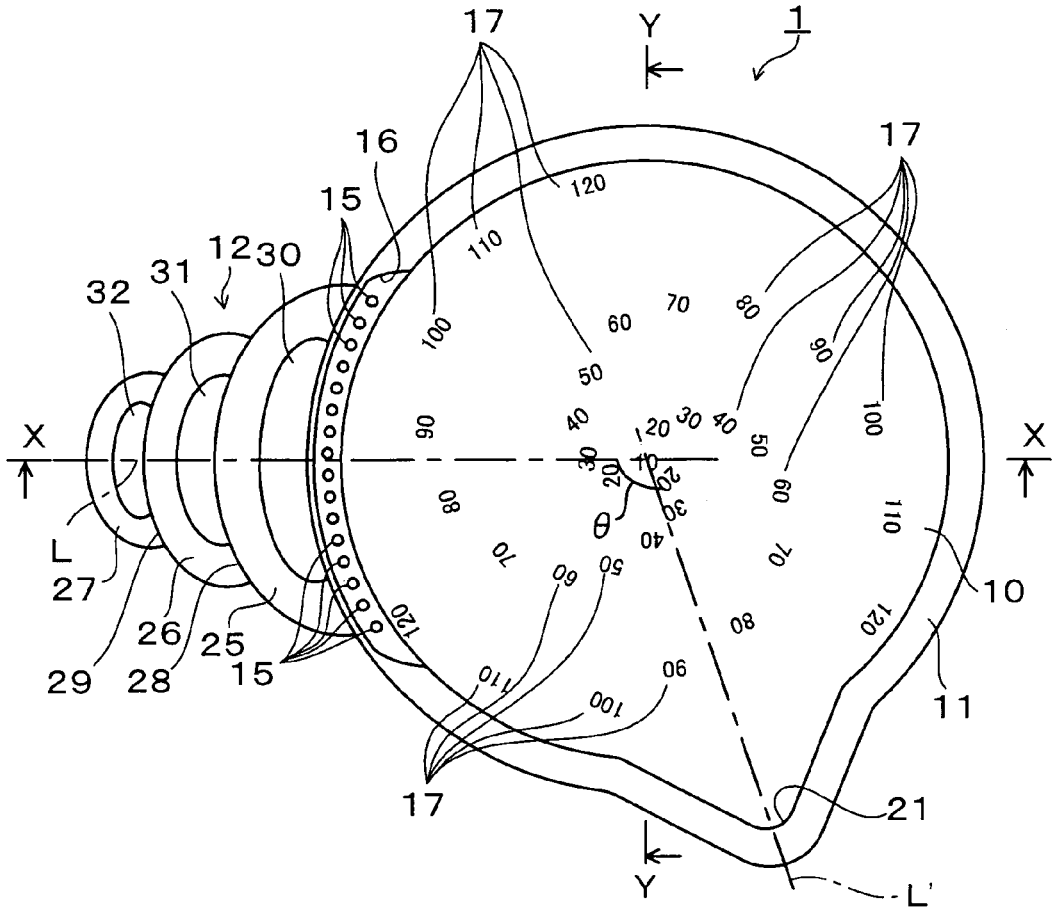
FIG. 1 is a plane view of a hair color cup according to an embodiment of the present invention.
Figure 2:
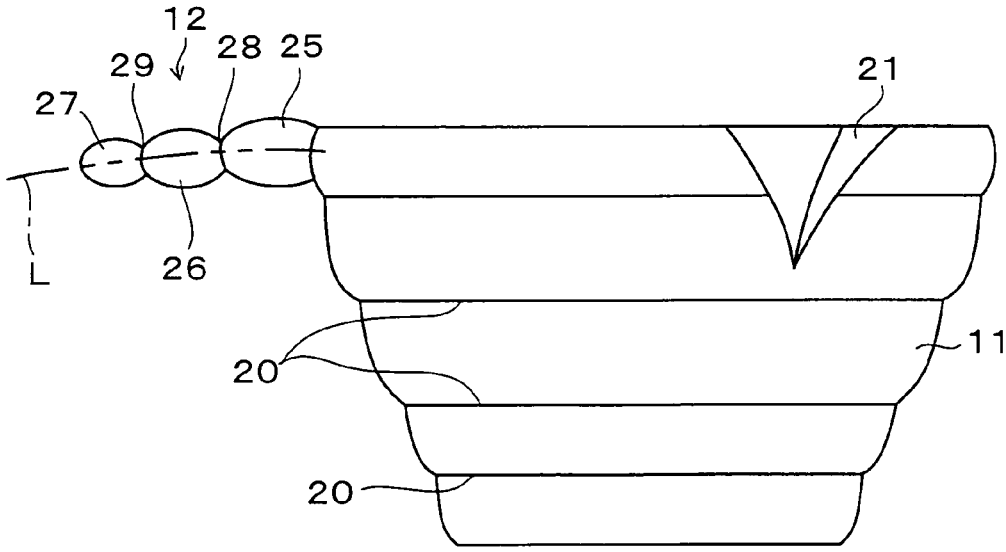
FIG. 2 is a side view of the hair color cup according to the embodiment of the present invention.
Figure 3:
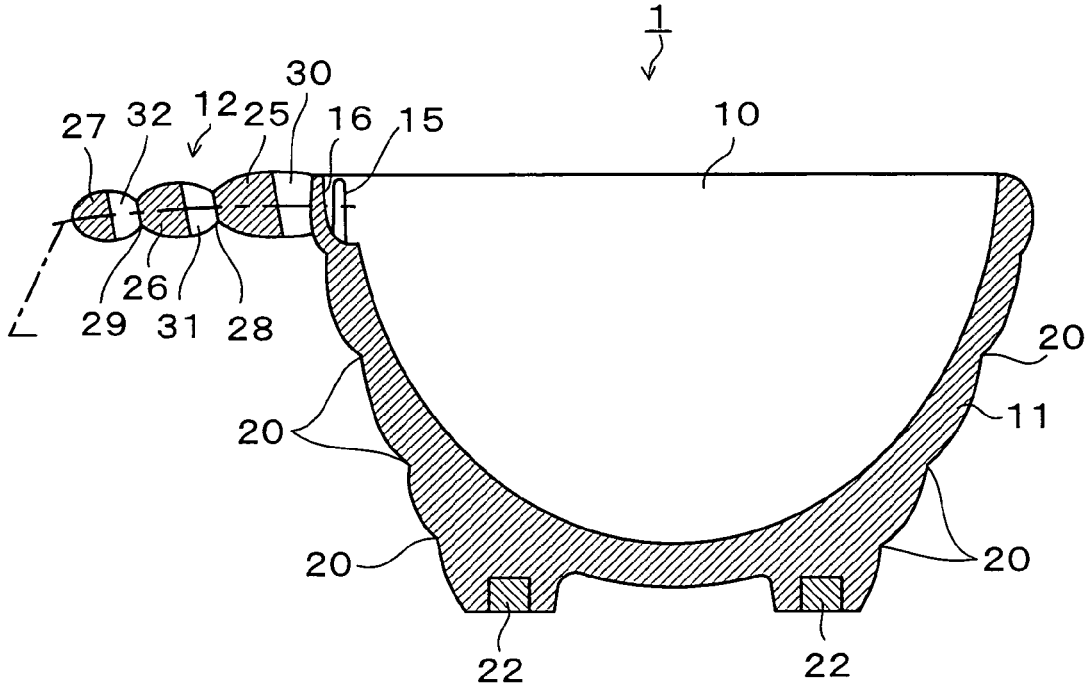
FIG. 3 is a sectional view taken along the line X to X in FIG. 1.
Figure 4:
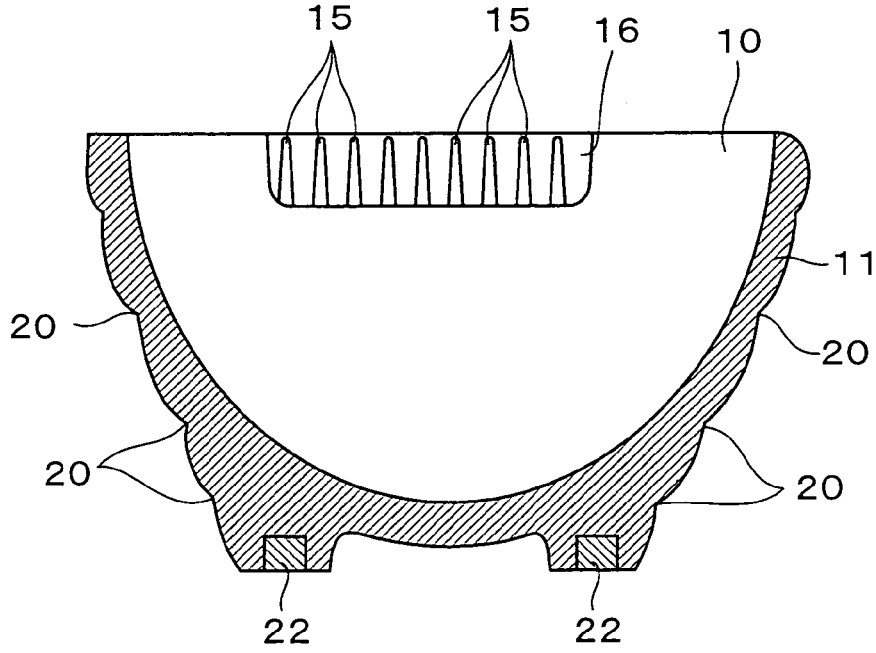
FIG. 4 is a sectional view taken along the line Y to Y in FIG. 1.

Hereinafter, a preferred embodiment of the present invention will be described with reference to the drawings. Note that in this embodiment, a hair color cup which contains a hair color for dying hair in a barber's shop, a beauty salon or the like will be described.

As shown in FIGS. 1 to 4, a hair color cup 1 according to the embodiment is formed to be recessed in a semispherical shape to contain a hair color a as a dye, and has a cup part 11 having a liquid storing part 10 with its top open. A handle part 12 for holding the cup part 11 is provided at an outer side of the cup part 11.

A plurality of comb teeth 15 are provided side by side at an upper position of an inner surface of the cup part 11 (upper position of the liquid storing part 10). In this embodiment, a recessed portion 16 is formed in the vicinity of a location at which a base portion of the handle part 12 is mounted at an upper position of the inner surface of the cup part 11, and in this recessed portion 16, a plurality of comb teeth 15 facing vertically upward are disposed to be aligned in parallel with a substantially equal space from each other. The respective comb teeth 15 are equal to each other in length, and the height of the upper end of each comb tooth 15 is substantially equal to the upper end portion of the opening of the cup part 11.

Arabic numerals 17, which are the scales for measure, are described on the inner surface of the liquid storing part 10 formed to be recessed in the semispherical shape as described above. Each of the Arabic numerals 17 described on the inner surface of the liquid storing part 10 like this becomes a larger number toward the upper position in the unit of 10, and by reading the nearest Arabic numeral 17 to the height of the liquid level of the hair color a contained in the liquid storing part 10, the amount of the hair color a (cc) can be grasped. In order to be able to read the Arabic numerals 17 even when seeing the hair color cup 1 from any direction, the Arabic numerals 17 are described at the positions in the three directions (120° intervals) in the inner surface of the liquid storing part 10.

A plurality of stages of annular grooves 20 (three stages in the example shown in the drawing) extending in the horizontal direction are formed on an outer surface of the cup part 11. The diameter of each of the grooves 20 is smaller in the groove 20 at a lower position. The portion between the respective grooves 20 is a convex curved surface which becomes narrower to a lower position.

A pourer 21 which projects outside from an upper end of the cup part 11 is formed at an upper position of the outer surface of the cup part 11. Sponge rubbers 22 are embedded in a plurality of locations (for example, five locations) on a bottom surface of the cup part 11.

The handle part 12 is constructed by three portions that are, a wide portion 25, an intermediate portion 26 and a narrow portion 27 in sequence from its base portion, a groove 28 is formed between the wide portion 25 and the intermediate portion 26, and a groove 29 is formed between the intermediate portion 26 and the narrow portion 27. These wide portion 25, intermediate portion 26 and narrow portion 27 are respectively provided with holes 30, 31 and 32 which are elliptical in plane view penetrating through them in the vertical direction. Among them, the hole 30 provided in the wide portion 25 is the largest, the hole 32 provided in the narrow portion 27 is the smallest, and the hole 31 provided in the intermediate portion 26 is about in an intermediate size between the hole 30 of the wide portion 25 and the hole 32 of the narrow portion 27.

When seeing the handle part 12 laterally, the handle part 12 is provided to be slightly inclined so that a center line L of the handle part 12 is curved to be convex upward, and the center line L lowers to the tip end (end side which is an opposite from the base portion of the cup part 11 mounted to the outer side of the cup part 11) of the handle part 12.

Besides, when seeing the hair color cup 1 from above, the positional relationship of the pourer 21 and the handle part 12 is set so that a center line L' indicating the position of the pourer 21 formed at the upper position of the outer surface of the cup part 11 and the center line L of the handle part 12 intersect each other at a larger angle than 90°.

When hair coloring is performed by using the hair color cup 1 according to this embodiment in a barber's shop, a beauty salon or the like, a barber or a hair dresser places the hair color cup 1 on a wagon near a customer sitting in a chair, or on a side board, table or the like, and places the hair color cup 1 near the head of the customer sitting in the chair. In this case, if the hair color cup 1 is placed on the top surface of the wagon or the like, the sponge rubbers 22, which are embedded in a plurality of locations on the bottom surface of the cup part 11 contact the top surface of the wagon or the like, and therefore, the hair color cup 1 can be placed stably on the flat top surface of the wagon or the like without making the hair color cup 1 unstable. When the sponge rubbers 22 are embedded in the five locations on the bottom surface of the cup part 11, the cup part 11 is more stabilized as compared with the case where one continuous rubber ring is disposed on the bottom surface of the cup part 11 and the case where the sponge rubbers are embedded in three or four locations on the bottom surface of the cup part 11.

Figure 5:
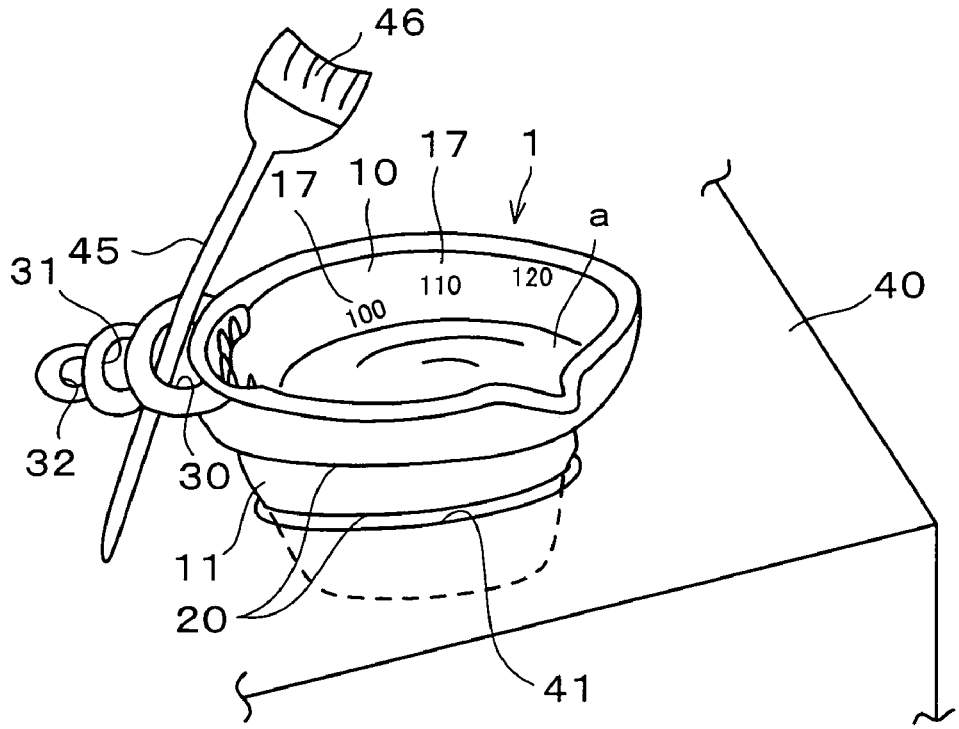
FIG. 5 is an explanatory view of a use state of the hair color cup according to the embodiment of the present invention.

Besides, as shown in FIG. 5, there is the case where a circular hole 41 for holding the hair color cup 1 is provided on the top surface 40 of the wagon or the like. In such a case, the hair color cup 1 can be held more stably by inserting a lower half portion of the cup part 11 in the circular hole 41. In this case, in the hair color cup 1, the outer surface of the cup part 11 is formed to be the convex curved surface narrowed toward the bottom as a whole, and a plurality of stages of grooves 20 having smaller diameters toward the bottom are formed on the outer surface of the cup part 11. Therefore, when the lower half portion of the cup part 11 is inserted into the circular hole 41 as shown in FIG. 5, the outer surface of the cup part 11 is in the state fitted in the circular hole 41 at the location of the proper groove 20, and the hair color cup 1 is held stably without becoming unstable.

The Arabic numerals for measure are described on the inner surface of the cup part 11 (liquid storing part 10), and therefore, when the hair color a as the dye is put into the liquid storing part 10 of the hair color cup 1, a barber or a hair dresser can easily grasp the amount (cc) of the hair color a by reading the nearest Arabic numeral 17 to the height of the liquid level of the hair color a which is put into the liquid storing part 10. In this case, the Arabic numerals 17 are described at the positions in the three directions (120° intervals) on the inner surface of the liquid storing part 10, and therefore, the barber or the hair dresser can read the Arabic numerals 17 even when the barber or the hair dresser sees the hair color cup 1 in any direction.

Then, the barber or the hair dresser puts a brush portion 46 at a tip end of a brush 45, for example, into the liquid storing part 10 of the hair color cup 1, and submerges the brush portion 46 in the hair color a. The barber or the hair dresser thus causes the hair color a to attach to the brush portion 46, and applies the hair color a scooped out of the liquid storing part 10 to the hair of the customer.

When the hair color a is scooped out of the liquid storing part 10 in this manner, the hair color a does not spread laterally but gathers in a center of the bottom portion of the liquid storing part 10 because the liquid storing part 10 is in the shape recessed in the semispherical shape, and therefore, the hair color a can be easily scooped out.

Figure 6:
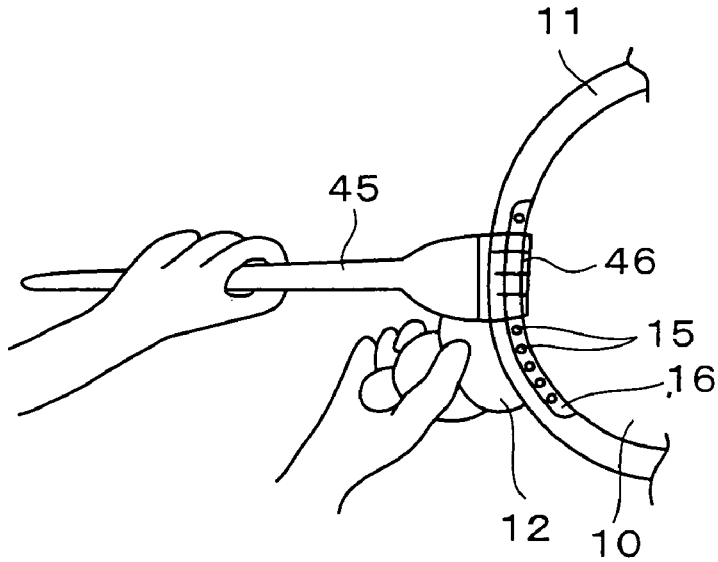
FIG. 6 is an explanatory view of the use state of the hair color cup according to the embodiment of the present invention.

Then, when the amount of the hair color a attaching to the brush portion 46 is too large when the barber or the hair dresser applies the hair color a to the hair of a customer, the barber or the hair dresser can easily scrape unnecessary hair color a off the brush portion 46 by pressing the brush portion 46 against a plurality of comb teeth 15 provided side by side at the upper position of the inner surface of the cup part 11 and brushing by moving the brush 45 as shown in FIG. 6. Besides, by brushing with the brush portion 46 pressed against the comb teeth 15 in this manner, the shape of the brush portion 46 can be settled. By causing a proper amount of hair color a to attach to the brush portion 46 in the settled shape in this manner and applying it to the hair of a customer, the operation is facilitated, and the hair color a does not drop from the brush portion 46 halfway.

Besides, when a barber or a hair dresser applies the hair color a to the hair of a customer with the brush 45 in this manner, hair, dust and the like sometimes attach to the brush portion 46. In such a case, by pressing the brush portion 46 against a plurality of comb teeth 15 provided side by side at the upper position of the inner surface of the cup part 11, and brushing by moving the brush 45 as shown in FIG. 6, the hair, dust and the like attaching to the brush portion 46 can be easily removed without contaminating the hands.

On brushing the brush portion 46 by the comb teeth 15, the hair color a drops from the brush portion 46, but the hair color a thus dropping from the brush portion 46 passes along the inner surface of the cup part 11 and flows into the liquid storing part 10 after being received in the recessed part 16, therefore the hair color a does not drop outside the cup part 11 and does not contaminate the periphery.

When brushing the brush portion 46 by the comb teeth 15 as above, the comb teeth 15 can be stabilized by pressing the handle part 12 with a hand which does not hold the brush 45 on brushing as shown in FIG. 6, because the comb teeth 15 are disposed side by side in the vicinity of the location at which the base portion of the handle part 12 is mounted, and brushing is easily performed.

Then, when the brush 45 is not used due to intermission of the operation or the like, the brush 45 is inserted into the hole 30 in the posture with the brush portion 46 up as shown in FIG. 5, whereby the brush 45 can be stood without contaminating the top surface 40 of the wagon or the like.

Besides, when holding the hair color cup 1 by a hand by gripping the handle part 12, it is difficult for the handle part 12 to fall off the hand because the entire handle part 12 is curved to be convex, and inclines downward to the tip end of the handle part 12, and therefore, even when the hair color cup 1 is heavy, the hair color cup 1 can be held firmly without slipping.

Besides, when the hair color a contained in the liquid storing part 10 is poured out from the pourer 21 while the handle part 12 is held, the positional relationship is such that the pourer 21 and the handle part 12 intersect each other at a larger angle than 90°, and the operation of pouring out the hair color a from the pourer 21 is facilitated.

Figure 7:
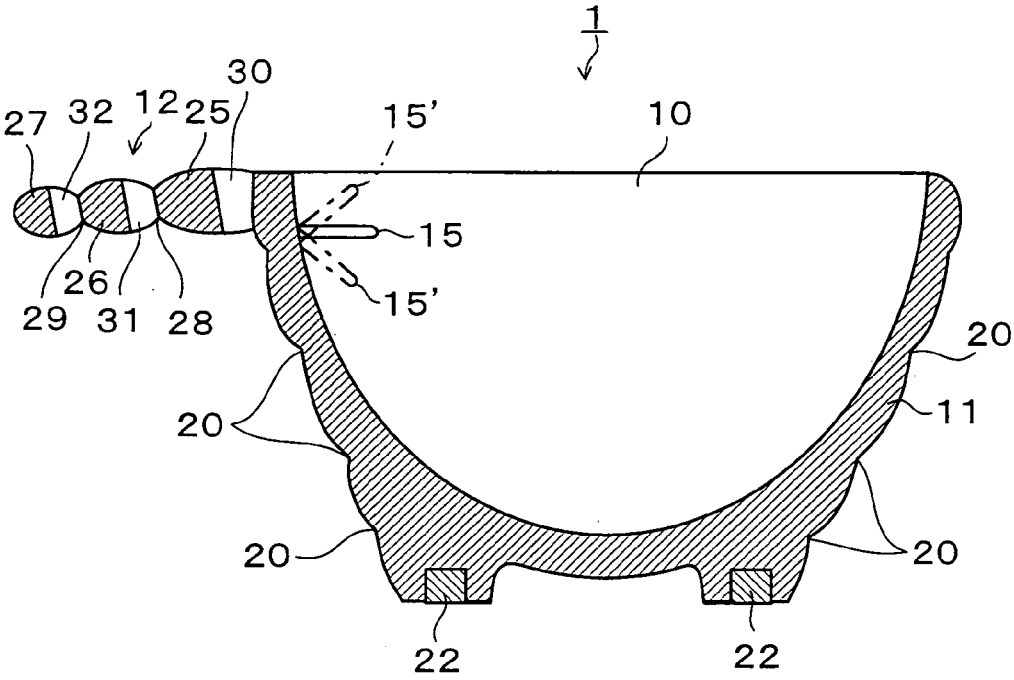
FIG. 7 is a vertical sectional view of a hair color cup according to another embodiment of the present invention, in which comb teeth are directly provided at an inner surface of a cup part.
Figure 8:
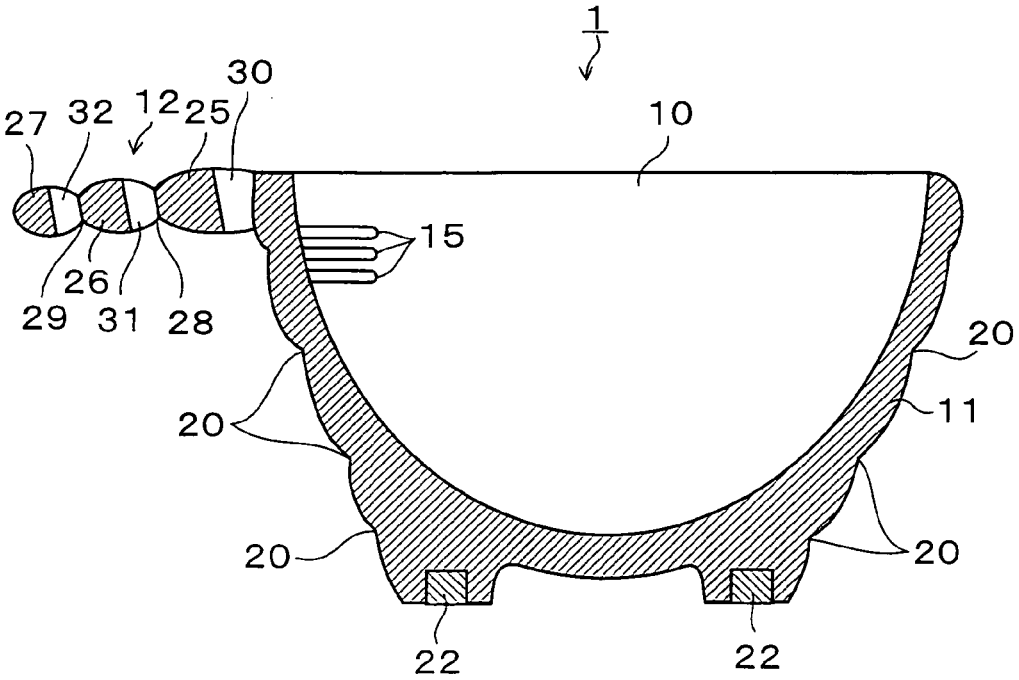
FIG. 8 is a vertical sectional view of a hair color cup according to another embodiment of the present invention, in which comb teeth are disposed side by side in the vertical direction.

An example of the preferred embodiment of the present invention is shown above, but the present invention is not limited to the mode shown here as the example. FIGS. 1 to 6 show the example in which the recessed portion 16 is formed in the vicinity of the location where the base portion of the handle part 12 is mounted in the inner surface of the cup part 11, and the comb teeth 15 are disposed there, but as shown in FIG. 7, the comb teeth 15 may be directly provided on the inner surface of the cup part 11 without forming the recesses portion on the inner surface of the cup part 11. The projecting direction of the comb teeth 15 is not limited to the vertical upward direction as explained in FIGS. 1 to 6. For example, the projecting direction may be the horizontal direction as the comb tooth shown by the solid line in FIG. 7, or it may be the diagonally downward direction as a comb tooth 15' shown by the chain line in FIG. 7, or it may be the diagonally upward direction as a comb tooth 15" shown by the two-dot chain line in FIG. 7. In any case, it is suitable to dispose a plurality of comb teeth to be arranged in parallel with a substantially equal space from each other. Besides, it is also possible to dispose a plurality of comb teeth 15 to be arranged in parallel with a substantially equal space from each other in the vertical direction as shown in FIG. 8, not in the lateral direction. Of course, it is also possible to dispose a plurality of comb teeth 15 to be arranged in parallel with a substantially equal space from each other in a diagonal direction. The embodiments shown in FIGS. 7 and 8 have the same construction as the embodiment explained above in FIGS. 1 to 6 in the other respects than the respect that the recessed portion is not formed on the inner surface of the cup part 11 and the respect that the orientation of the comb teeth 16 is changed. Therefore, in FIGS. 7 and 8, the components common to the embodiment explained in FIGS. 1 to 6 before are given the same reference numerals and symbols, and the redundant explanation will be omitted.

Figure 9:
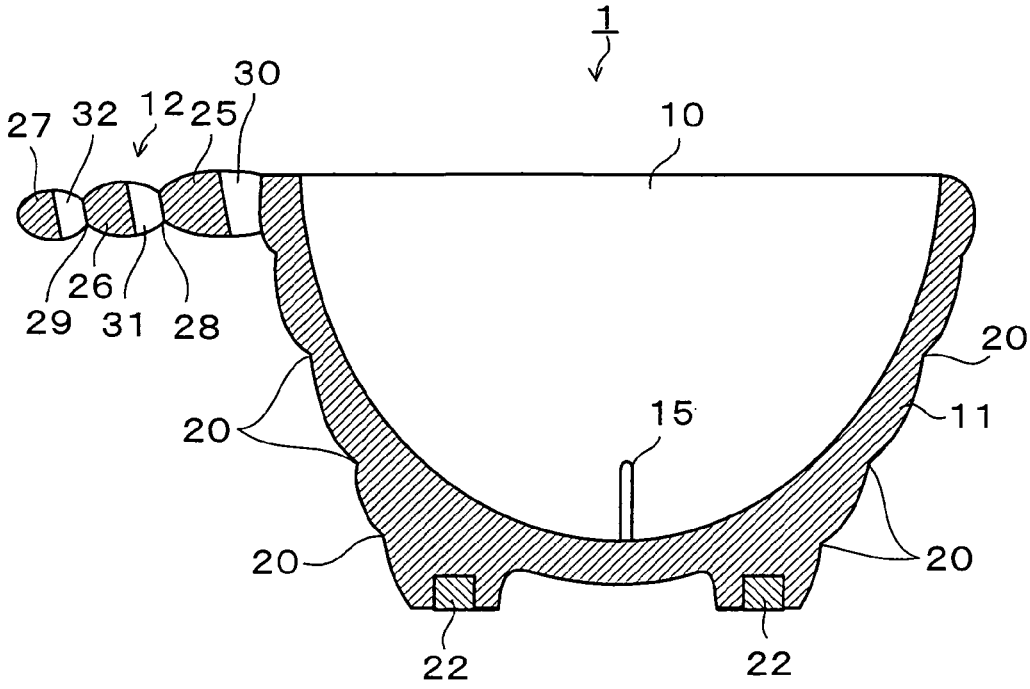
FIG. 9 is a vertical sectional view of a hair color cup according to another embodiment of the present invention, in which comb teeth are disposed at a bottom portion of an inner surface of a cup part.

Besides, as shown in FIG. 9, the comb tooth 15 may be provided at the bottom portion of the inner surface of the cup part 11.

Figure 10:
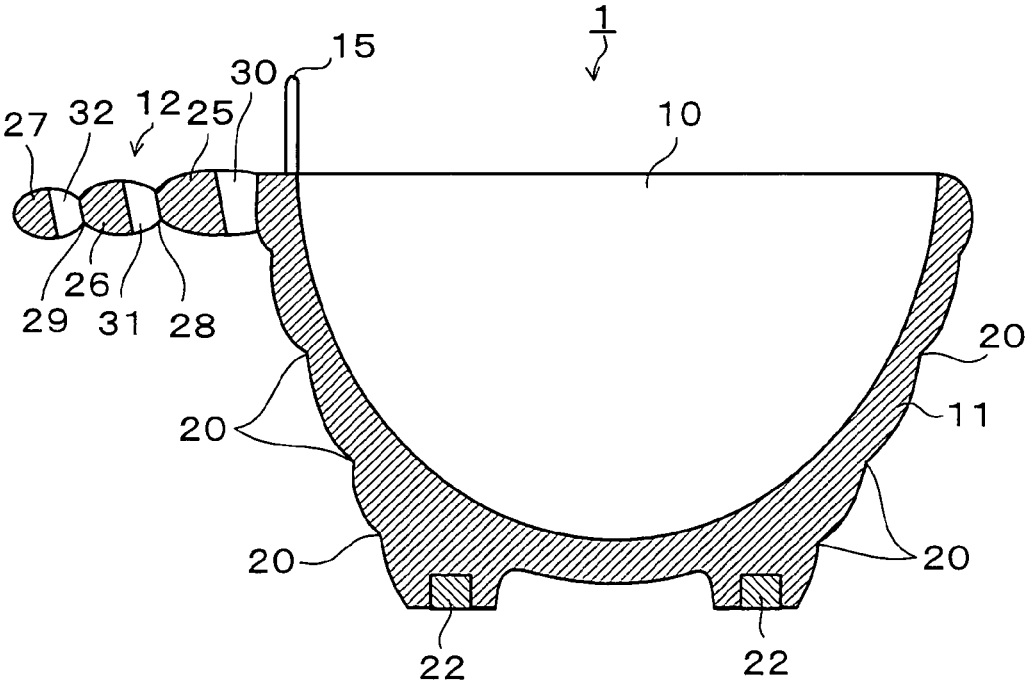
FIG. 10 is a vertical sectional view of a hair color cup according to another embodiment of the present invention, in which comb teeth are disposed at an upper end surface of the cup part.

Further, as shown in FIG. 10, the comb teeth 15 may be provided side by side at the upper end surface of the cup part 11, for example. Besides, in the embodiments shown in FIGS. 9 and 10, the orientation of the comb teeth 15 is not limited to the vertical direction, but the comb teeth may project laterally, or the comb teeth may project diagonally upward, or diagonally downward.

In FIGS. 9 and 10, the components common to the embodiment explained above in FIGS. 1 to 6 are also given the same reference numerals and symbols, and the redundant explanation will be omitted.

Besides, the length of the comb tooth 15 is optional, and the height of the upper end of the comb tooth 15 may not be always substantially equal to that of the opening upper end portion of the cup part 11, the height of the upper end of the comb tooth 15 may be lower than that of the opening upper end portion of the cup part 11, or may be higher on the other hand.

Besides, the disposition of the comb teeth 15 is not limited to the location in the vicinity of the location where the base portion of the handle part 12 is mounted, and the comb teeth 15 may be located at the position away from the base portion of the handle part 12.

If the hair color cup 1 is constructed of a transparent material, the color, the amount and the like of the hair color a contained in the liquid storing part 10 can be visually observed easily from outside. Besides, if the hair color cup 1 is constructed of a transparent material, the groove 20 formed on the outer surface of the cup part 11 can be seen from the inner surface of the cup part 11, and it becomes possible to grasp the amount of the hair color a with the groove 20 as the reference. For example, it is made easy to decrease the amount of the hair color a for retouch, or to increase the amount of the hair color a for an entire head.

By properly disposing the projected portion on the inner surface of the cup part 11 (liquid storing part 10), a cream or the like which is difficult to mix can be mixed without an undissolved lump, and can be emulsified in a short time. In this case, the projected portion formed on the inner surface in the cup part 11 (the liquid storing part 10) can be disposed at any position on the vertical line, the annular line and the like.

Besides the above description, by etching the handle part 12, the outer surface b of the cup part 11 and the like, the hair color cup 1 which hardly slips as a whole can be provided.

The dye cup of the present invention is not limited a hair color cup. It can be applied to any dye cup containing various kinds of dyes such as, for example, a painting material, and the other dyes and the like. The capacity of the dye cup is optional, and cups of various capacities such as 300 cc, 1 liter and the like, for example, can be provided.

INDUSTRIAL AVAILABILITY

The dye cup of the present invention can be utilized in barber's shops, beauty salons and the like, for example.

The invention claimed is:

1. A dye cup comprising:

a cup part with a top open for containing a dye therein, wherein a plurality of comb teeth are provided side by side at an upper end surface of the cup part or at an upper position of an inner surface of the cup part, and wherein a recessed portion is formed at the upper position of the inner surface of the cup part, and the plurality of comb teeth are provided side by side in this recessed portion.

2. The dye cup according to claim 1, wherein said dye is a hair color.

3. The dye cup according to claim 1, wherein a handle part for holding the cup part is provided at an outer side of the cup part.

* * * * *